US008684048B2

(12) United States Patent
Koga

(10) Patent No.: US 8,684,048 B2
(45) Date of Patent: Apr. 1, 2014

(54) STANDALONE PACKAGING MANIPULATION APPARATUS

(75) Inventor: Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 568 days.

(21) Appl. No.: 13/035,738

(22) Filed: Feb. 25, 2011

(65) Prior Publication Data

US 2011/0209441 A1 Sep. 1, 2011

(30) Foreign Application Priority Data

Feb. 26, 2010 (JP) ..... 2010-41182

(51) Int. Cl.
*B65B 43/42* (2006.01)
*B65B 39/14* (2006.01)

(52) U.S. Cl.
CPC ..... *B65B 39/145* (2013.01)
USPC ..... 141/147; 141/144; 141/145; 141/146

(58) Field of Classification Search
CPC ..... B65B 39/12; B65B 39/14; B65B 39/145; B65B 39/001–39/005
USPC ..... 141/144–147, 166
See application file for complete search history.

(56) References Cited

U.S. PATENT DOCUMENTS

| | | | | | |
|---|---|---|---|---|---|
| 2,768,655 | A | * | 10/1956 | Bergeron | 141/65 |
| 3,419,053 | A | * | 12/1968 | Tanner | 141/145 |
| 4,522,017 | A | * | 6/1985 | Scheffers | 53/570 |
| 6,604,560 | B2 | * | 8/2003 | Ikemoto et al. | 141/147 |

FOREIGN PATENT DOCUMENTS

| | | | |
|---|---|---|---|
| EP | 1 253 084 | A | 10/2002 |
| JP | S59-46874 | B | 11/1984 |
| JP | 2000-142890 | A | 5/2000 |
| JP | 4190067 | B | 12/2008 |
| JP | S59-46874 | A | 1/2009 |

* cited by examiner

*Primary Examiner* — Timothy L Maust
(74) *Attorney, Agent, or Firm* — DLA Piper LLP (US)

(57) ABSTRACT

A standalone packaging manipulation apparatus performing predetermined packaging manipulation operations on bags being transported along an arcuate transportation path of a rotary-type bag transportation apparatus, the standalone packaging manipulation apparatus including a main arm that pivots and also extends and retracts in a horizontal plane, a sub-arm provided at a distal end portion of the main arm so as to ascend and descend and to rotate in the horizontal plane, and filling nozzle provided on the sub-arm with a predetermined spacing therebetween and simultaneously filling a plurality of bags with liquid. The operation of these elements is performed by mutually independent servomotors.

6 Claims, 6 Drawing Sheets

STANDALONE PACKAGING MANIPULATION APPARATUS

BACKGROUND OF THE INVENTION

1. Field of the Invention

The present invention relates to a standalone packaging manipulation apparatus that is disposed adjacent to a rotary container transportation apparatus having an arcuate transportation path and performs predetermined packaging manipulation operations on containers being transported along the arcuate transportation path.

2. Description of the Related Art

Packaging manipulation apparatuses that carry out predetermined packaging manipulation operations on containers that are being transported by a rotary container transportation apparatus along an arcuate transportation path in a horizontal plane while moving packaging manipulating members in synchronism with the containers have been used in packaging machines. The packaging manipulating members are moved (or advanced) in synchronism with the containers from its initial position on the arcuate transportation path within a predetermined range along the arcuate transportation path and, after stopping at the point of advance end, returned (or moved back) to the initial position. The predetermined packaging manipulation operations are carried out on the containers during the advance motion of the manipulating members (including at the stopped moment thereof).

Rotary container transportation apparatuses having arcuate transportation paths include a type that includes a circular transportation path (consisting of arcuate transportation paths only) and a type that includes a race track-shaped transportation paths (including arcuate transportation paths at both ends), and the manner of transport includes both continuous transportation and intermittent transportations.

In a bottling machine (which corresponds to the packaging machine in the description of the present invention) disclosed in, for example, Japanese Patent Application Laid-Open (Kokai) No. S59-46874, a liquid-filling device (which corresponds to the packaging manipulation apparatus of the present invention) is provided above a table (which corresponds to the rotary container transportation apparatus in the description of the present invention) that intermittently transports bottles along a circular transportation path. This filling device includes a spindle that is positioned in the center of the table (and is thus in the center of the circular transportation path), a fan-shaped nozzle support member secured to the spindle, and a plurality of liquid-filling nozzles (which correspond to the packaging manipulating members of the present invention) disposed in an arcuate shape with a predetermined spacing therebetween along the perimeter of the nozzle support member. As the spindle rotates in a reciprocatory manner, the filling nozzles are intermittently moved (or advanced) along the circular (arcuate) bottle transportation path in synchronism with the transport of the bottles and then, after stopping at the point of advance end, moved back (or returned) to the initial position. The filling nozzles are lowered in the initial position and raised at the point of advance end. A mechanism that reciprocatingly rotates the spindle, that is, a mechanism that causes the filling nozzles to reciprocatingly revolve along the arcuate transportation path, is incorporated in the intermittent drive mechanism of the table.

In the packaging machine disclosed in Japanese Patent Application Laid-Open (Kokai) No. 2009-1322, a mouth-holding device (that corresponds to the packaging manipulation apparatus of the present invention) is installed in the vicinity of a table (which corresponds to the rotary container transportation apparatus in the description of the present invention) that intermittently transports bags along a circular transportation path. The mouth-holding device includes a guide rail installed at the exterior of the circular transportation path, concentric therewith, a slider configured to reciprocate along the guide rail, a pair of mouth-opening claws (which correspond to the packaging manipulating members of the present invention) installed on the slider, and an opening and closing mechanism therefor. As the slider is moved in a reciprocating manner, the two mouth-opening claws are intermittently moved (advanced) along the circular (arcuate) bag transportation path in synchronism with the transport of the bags and, after stopping at the point of advance end (or the end of forward motion), returned (moved back) to the initial position. The mouth-opening claws etc. are lowered in the initial position, opened immediately after the start of the advance motion, raised at the point of advance end, and then closed immediately before arriving at the initial position. A mechanism that raises and lowers and reciprocates the slider, that is, a mechanism that raises and lowers the mouth-opening claws and reciprocates them along the arcuate transportation path, is incorporated in the intermittent drive mechanism of the table.

In any of the cases described above, the reciprocating path of the packaging manipulating members is structurally predefined. In other words, it is a reciprocating rotation about a spindle in the bottling machine disclosed in Japanese Patent Application Laid-Open (Kokai) No. S59-46874, and it is a reciprocating motion along a guide rail in the packaging machine disclosed in Japanese Patent Application Laid-Open (Kokai) No. 2009-1322. In addition, a drive mechanism that reciprocates the packaging manipulating members is incorporated in the drive mechanism of the rotary container transportation apparatus. For this reason, from the standpoint of the mechanism, it is relatively easy to have the packaging manipulating members advance in synchronism with the transport of the containers along the arcuate transportation path by the rotary container transportation apparatus and then bring them back to the initial position.

However, the apparatuses disclosed in Japanese Patent Application Laid-Open (Kokai) Nos. S59-46874 and 2009-1322 have such problems that:

(1) The packaging manipulation apparatus cannot be readily separated from the rotary container transportation apparatus even when separation becomes necessary. For this reason, in the apparatus of, for example, Japanese Patent Application Laid-Open (Kokai) No. S59-46874, it is necessary to stop the entire bottling machine in order to clean the filling nozzles when changing the filling liquid; which inevitably results in a loss of productivity.

(2) The packaging manipulating members are moved along the same path when advancing and returning. For this reason, in the apparatus of, for example, Japanese Patent Application Laid-Open (Kokai) No. S59-46874, when the filling nozzles are returned along the bottle transportation path, liquid dripping from the nozzles may potentially get on the bottles.

(3) The packaging manipulation apparatus is configured to be used with a specific rotary container transportation apparatus, and thus, the packaging manipulation apparatus lacks versatility. For example, the same packaging manipulation apparatus cannot be used with rotary container transportation apparatuses that have arcuate transportation paths of different radii.

(4) Likewise, the range of advance and return motion of the packaging manipulating members always remains constant and cannot be changed, which contributes to the lack of versatility. For this reason, in the apparatus of, for example, Japanese Patent Application Laid-Open (Kokai) No. S59-

46874, a choice has to be made between reducing the speed of bottle transportation and increasing the idle time, when it is desired to lengthen the filling time depending on the properties or amount of the dispensed liquid.

In contrast to the above described apparatuses, there exist packaging manipulation apparatuses which are separate in terms of drive mechanisms from rotary container transportation apparatuses. However, the only available packaging manipulation apparatuses of this type is that which works when containers, transported by an intermittent transportation-type rotary container transportation apparatus, are stopped or that which works with containers transported along a rectilinear transportation path in a rotary container transportation apparatus (in which the packaging manipulating members are moved in synchronism with the transport of the containers along the rectilinear transportation path). In the former type of apparatus, the packaging manipulation apparatus operates only in the stop positions of the containers (e.g., the filling nozzles are raised and lowered at the container stop positions) and does not operate in synchronism with the transport of the containers. The latter type of apparatus is disclosed in, for instance, Japanese Patent No. 4,190,067. It should be noted that while the packaging manipulation apparatus of Japanese Patent No. 4,190,067 has a drive mechanism that is separated from a rotary container transportation apparatus, it is provided inside the container transportation path and is accordingly not structurally separated from the rotary container transportation apparatus.

When the drive mechanism of the packaging manipulation apparatus disclosed in Japanese Patent Application Laid-Open (Kokai) Nos. S59-46874 and 2009-1322 is incorporated into the drive mechanism of a rotary container transportation apparatus, it is relatively easy, from the standpoint of the drive mechanism, to move the packaging manipulating members along the arcuate transportation path in synchronism with the transport of the containers. However, as previously noted, this type of packaging manipulation apparatus lacks versatility.

On the other hand, among the packaging manipulation apparatuses that are separate from rotary container transportation apparatuses (or standalone packaging manipulation apparatuses) in terms of their drive mechanisms and structure, there are no such apparatuses that are configured to move the packaging manipulating members along an arcuate container transportation path in synchronism with the transport of containers. In addition, the very idea of making standalone packaging manipulation apparatuses of this type more versatile has not arisen yet presently.

BRIEF SUMMARY OF THE INVENTION

Accordingly, it is an object of the invention to provide a standalone packaging manipulation apparatus that performs predetermined packaging manipulation operations on containers being transported along an arcuate transportation path of a rotary container transportation apparatus, in which the packaging manipulating members are moved along the arcuate container transportation path in synchronism with the transport of the containers.

It is another object of the present invention to provide a standalone packaging manipulation apparatus that has a versatility to be used with various types of rotary container transportation apparatuses.

The above objects are accomplished by a unique structure of the present invention for a standalone packaging manipulation apparatus disposed adjacent to a rotary container transportation apparatus having an arcuate transportation path and performs predetermined packaging manipulation operations on containers being transported along the arcuate transportation path; and in the present invention, the standalone packaging manipulation apparatus includes:

- an arm having a pivoting fulcrum thereof at the exterior of the arcuate transportation path and configured to pivot horizontally and also to extend and retract in the length-wise direction;
- a packaging manipulating member(s) provided at a distal end portion of the arm and configured to ascend and descend;
- a first drive means for pivoting the arm horizontally;
- a second drive means for extending and retracting the arm in the length-wise direction;
- a third drive means for raising and lowering the packaging manipulating member(s); and
- a control unit for controlling the first, second and third drive means:
  - to advance the packaging manipulating member(s) along the arcuate transportation path in synchronism with the transport of the containers and, upon reaching a point of advance end, move the packaging manipulating member(s) back to an initial position thereof, and
  - to raise and lower the packaging manipulating member (s) at predetermined timing during the reciprocating stroke of the packaging manipulating member.

The above objects are further accomplished by another unique structure of the present invention for a standalone packaging manipulation apparatus disposed adjacent to a rotary container transportation apparatus having an arcuate transportation path and performs predetermined packaging manipulation operations on containers being transported along the arcuate transportation path; and in the present invention, the standalone packaging manipulation apparatus includes:

- a main arm having a pivoting fulcrum at the exterior of the arcuate transportation path and configured to pivot horizontally;
- a sub-arm provided at a distal end portion of the main arm and configured to rotate horizontally;
- a packaging manipulating member(s) provided on the sub-arm and configured to ascend and descend relative to the main arm;
- a first drive means for pivoting the main arm horizontally;
- a second drive means for rotating the sub-arm about an axis thereof;
- a third drive means for raising and lowering the packaging manipulating member(s); and
- a control unit for controlling the first, second, and third drive means:
  - to advance the packaging manipulating member(s) along the arcuate transportation path in synchronism with the transport of the containers and, upon reaching a point of advance end, move the packaging manipulating member(s) back to an initial position thereof, and
  - to raise and lower the packaging manipulating member (s) at predetermined timing during the reciprocating stroke of the packaging manipulating member.

In addition, the above objects are further accomplished by still another unique structure of the present invention for a standalone packaging manipulation apparatus disposed adjacent to a rotary container transportation apparatus having an arcuate transportation path and performs predetermined packaging manipulation operations simultaneously on a plurality of containers being transported along the arcuate transportation path; and in the present invention, the standalone packaging manipulation apparatus includes:

- a main arm having a pivoting fulcrum at the exterior of the arcuate transportation path and configured to pivot horizontally and also to extend and retract in the length-wise direction;
- a sub-arm provided at a distal end portion of the main arm and configured to rotate horizontally;
- a plurality of packaging manipulating members configured to ascend and descend relative to the main arm, the packaging manipulating members being installed on the sub-arm with a predetermined spacing therebetween and for performing packaging manipulation operations simultaneously on the plurality of containers;
- a first drive means for pivoting the main arm horizontally;
- a second drive means for extending and retracting the main arm in the length-wise direction;
- a third drive means for rotating the sub-arm about an axis thereof;
- a fourth drive means for raising and lowering the packaging manipulating members; and
- a control unit for controlling the first, second, third and fourth drive means
  - to advance the plurality of packaging manipulating members along the arcuate transportation path in synchronism with the transport of the plurality of containers and, upon reaching a point of advance end, move the plurality of packaging manipulating members back to initial positions thereof, and
  - to raise and lower the plurality of packaging manipulating members at predetermined timing during the reciprocating stroke of the packaging manipulating members.

In the above-described apparatuses that include the main arm and sub-arm, the packaging manipulating member(s) is movable to ascend and descend relative to the main arm, and this structure includes the case that the sub-arm is configured to ascend and descend relative to the main arm, and, as a result, the packaging manipulating member(s) on the sub-arms is raised and lowered relative to the main arm via the sub-arm. In this case, the drive means that raises and lowers the packaging manipulating member(s) is the drive means that raises and lowers the packaging manipulating member(s) relative to the main arm via the sub-arm (in other words, the drive means that raises and lowers the sub-arm relative to the main arm).

A rotary container transportation apparatus and the standalone packaging manipulation apparatus of the present invention form a part of a packaging machine. The standalone packaging manipulation apparatus assumes a part of the packaging manipulation process performed by the packaging machine on the containers that are being transported by the rotary container transportation apparatus.

The term "rotary container transportation apparatus having an arcuate transportation path" includes a rotary container transportation apparatus that includes a circular transportation path (including arcuate transportation path only) or includes at least a partially arcuate transportation path, such as a race track-shaped transportation path (including arcuate transportation paths at both ends of the path). The manner of transport of the container includes continuous transportation and intermittent transportation.

In addition, the term "packaging manipulation apparatus" (packaging manipulating member(s) includes any packaging manipulation apparatus (packaging manipulating member (s)) that performs packaging manipulation operation on containers; and thus, examples include a liquid-filling apparatus (liquid-filling nozzles), gas filling apparatus (gas injection nozzles), capping apparatus (capping heads), etc.

Furthermore, the packaging manipulation apparatus of the present invention can take the following forms:

(1) The drive means that operate the components of the packaging manipulation apparatus are preferably servomotors. In this case, two or more operations can be carried out using a shared servomotor (jointly used drive means), and different servomotors can be used as drive means for each operation (independent drive means).

(2) The path of return of the packaging manipulating member(s) can be the same or different from the path of advance. Although the path of advance is arcuate as in the same manner as the arcuate container transportation path of a container transportation apparatus, the path of return of the packaging manipulating member(s) can deviate or different from the arcuate transportation path, and a rectilinear path can be taken as the path of return of the packaging manipulating member (s).

(3) The packaging manipulating member(s) is, for example, a liquid-filling nozzle(s).

(4) The mode of travel of the packaging manipulating member(s) during the forward stroke and during the return stroke can be different. For example, during the forward stroke, the members can be moved intermittently in synchronism with the transport of the containers and, during the return stroke, they can be brought back to the initial position in a continuous motion.

The standalone packaging manipulation apparatus according to the present invention is capable of moving (advancing) its packaging manipulating member(s) along the arcuate container transportation path in synchronism with the transport of the containers by a container transportation apparatus, and, at the same time, it possesses versatility that allows it to be used with rotary container transportation apparatuses of various types. Accordingly, the packaging manipulating apparatus of the present invention has the following advantages:

(1) Since it is a standalone type, it can be separated from a rotary container transportation apparatus if necessary. As a result, when it is used in, for example, the bottling machine disclosed in Japanese Patent Application Laid-Open (Kokai) No. S59-46874, there is no need to wait for the liquid-filling nozzles to be cleaned because the packaging manipulation (liquid-filling) apparatus of the present invention can be switched to another liquid-filling apparatus (whose liquid-filling nozzles have already been cleaned) and the bottling machine can be immediately restarted, which increases the productivity.

(2) The same packaging manipulation apparatus can be used with, for example, different rotary container transportation apparatuses that have arcuate transportation paths of various radii. Since the packaging manipulation apparatus of the present invention has such flexibility, it can be possible to reduce the production costs of the packaging manipulation apparatus.

(3) The range of advance and return motion of the packaging manipulating member(s) of the present invention is also versatile. For example, when it is used in a bottling machine disclosed in Japanese Patent Application Laid-Open (Kokai) No. 559-46874, the packaging manipulating apparatus of the present invention has a liquid-filling nozzle(s), and the range of advance and return motion of the liquid-filling nozzle(s) can be expanded if a longer filling time is required depending on the properties or amount of the dispensed liquid. As a result, the operation can be performed without decreasing the bottle transportation speed (the rotational speed of the table), thus avoiding a reduction in productivity. Alternatively, if necessary, the range of advance and return motion of the liquid-filling nozzles can be rendered narrower.

(4) A path that is different from the path of advance can be selected as the path of return of the packaging manipulating member(s). For example, when the packaging manipulating member(s) is a liquid-filling nozzle(s), then the deviation of the path of return from the arcuate container transportation path makes it possible to prevent liquid dripping from the nozzles from getting onto the containers to which liquid filling has just been completed. In addition, if a rectilinear path is selected as the path of return of the packaging manipulating member (s), the return time can be shortened and the productivity of the packaging machine can be improved.

(5) A selection of the mode of travel of the packaging manipulating member(s) during the return stroke can be made freely. Even when the packaging manipulating embers are moved intermittently in synchronism with the transport of the containers during the forward or advance stroke, they can be brought to the initial position in a continuous (non-intermittent) motion during the return stroke. This can shorten the return time of the packaging manipulating member(s) and improve the productivity of the packaging machine.

DETAILED DESCRIPTION OF THE INVENTION

A standalone packaging manipulation apparatus according to the present invention will be described below in more detail with reference to the accompanying drawings of FIG. 1 through FIG. 6.

Figure 1:
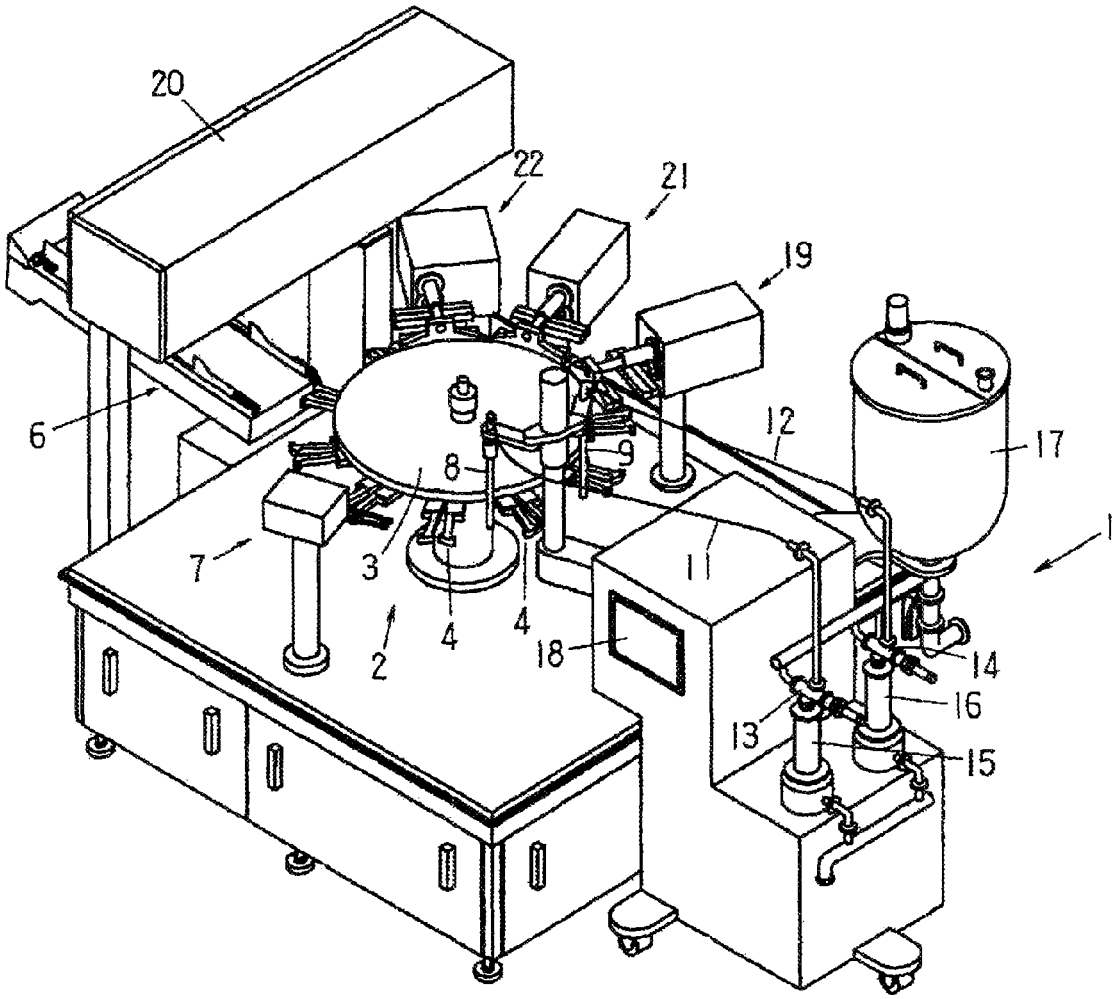
FIG. 1 is a perspective view of an entire packaging machine equipped with the packaging manipulation apparatus according to the present invention.

FIG. 1 is a perspective view of an intermittent rotation-type bag filling packaging machine provided with a standalone packaging manipulation apparatus (liquid-filling apparatus) 1 according to the present invention. The bag-filling packaging machine is provided with a rotary-type bag transportation apparatus that includes a round table 3 which intermittently rotates in a single direction (counter-clockwise in FIG. 1) and multiple pairs of grippers 4 are disposed around the round table at equal intervals.

As the table 3 rotates intermittently, the grippers 4 are intermittently moved along a circular transportation path formed by the round table 3 in a horizontal plane. During the full rotation of the table 3 (and grippers 4), various packaging manipulation operations are performed, including supply of bags 5 (see FIGS. 2 and 3) to the grippers 4, filling of the bags 5 gripped by the side edges by the grippers 4 with liquid, and sealing of the openings (mouths) of the bags 5, etc. The transportation path of the grippers 4 is in other words the transportation path of the bags 5.

A full rotation of the table 3 includes ten (10) stops and motions, with various packaging manipulation operations executed during a total of ten (10) operations.

Referring more specifically to FIG. 1, the first operation is a bag-feeding operation. In this operation, a conveyor magazine-type bag-feeding device 6 disposed in the vicinity of the stop position (first stop position) of the grippers 4 supplies bags 5 to the grippers 4. Each of the supplied bags 5 has the opening at the top edge, and the grippers 4 grip the bag by side edges near the opening (mouth). The bag 5 is thus suspended with the opening facing upward.

The second operation is a printing operation. A printer (not shown), which prints dates, etc., on the exterior surface of the bags 5 held by the grippers 4, is disposed in the vicinity of the stop position (second stop position) of the grippers 4.

The third operation is a print inspection operation. A print inspection device (not shown), which inspects, for instance, the characters printed on the outer surface of the bag 5 held by the grippers 4, is disposed in the vicinity of the stop position (third stop position) of the grippers 4.

The fourth operation is a mouth-opening operation. A mouth-opening device 7, which opens the mouth of the bag 5 held by the grippers 4, is disposed in the vicinity of the stop position (fourth stop position) of the grippers 4. The mouth-opening device 7 has a pair of suction members (suction cups) configured to be moved towards and away from each other (to open the mouth).

Operations 5 through 7 are liquid filling operations. These operations are performed on the bags 5 in a continuous manner while one bag 5 is transported (intermittently transported) from, as seen from FIG. 2, the fifth stop position (V) to the sixth stop position (VI) of the grippers 4 and another bag is simultaneously transported (intermittently transported) from the sixth stop position to the seventh stop position (VII) of the grippers 4.

The liquid-filling apparatus 1 is disposed at the exterior of the arcuate path of transportation of the bags 5 where liquid filling operations are performed. Among other constituting elements, the liquid-filling apparatus 1 is, as seen from FIG. 1, provided with two filling nozzles 8 and 9, supply conduits 11 and 12 respectively corresponding to the filling nozzles 8 and 9, flow path changeover valves 13 and 14, volume measuring pumps 15 and 16 along with a shared liquid storage tank 17, and a control unit 18. The liquid-filling apparatus 1 is independent from the rotary-type bag transportation apparatus both structurally and in terms of its drive mechanism.

The eighth operation is a first sealing operation. In this first sealing operation, a first sealing device 19 disposed in the vicinity of the stop position (eighth stop position (VIII)) of the grippers 4 performs a first heat-sealing operation to the mouth of the each one of the bags 5 held by the grippers 4. The first sealing device 19 has a pair of seal bars.

The ninth operation is a second sealing operation. In this second sealing operation, a second sealing device 21 disposed in the vicinity of the stop position (ninth stop position) of the grippers 4 performs a second heat-sealing operation to the mouth of the bag 5 held by the grippers 4. The second sealing device 21 has a pair of seal bars as well.

The tenth operation is a seal-cooling and product release operation. A seal-cooling device 22 disposed in the vicinity of the stop position (tenth stop position) of the grippers 4 cools the sealed portion of the bag 5 held by the grippers 4. The seal-cooling device 22 has a pair of cooling bars that grip and cool the sealed portions.

During the tenth operation, the grippers 4 are opened, and the cooling bars are opened, and thus the bag 5, as a finished product, is dropped onto, for example, a conveyor which carries the bag out of the bag-filling packaging machine.

The reference numeral 20 in FIG. 1 is a control unit provided in the bag-filling packaging machine.

The liquid-filling apparatus 1 of the present invention will be described in greater detail below with reference to FIGS. 2 and 3.

The liquid-filling apparatus 1 includes a main arm 23 that has a pivoting fulcrum disposed at the exterior of the arcuate transportation path along which the bags 5 are transported. The main arm 23 is provided so as be pivotable in a horizontal plane and is free to extend and retract in its length-wise direction. The liquid-filling apparatus 1 further includes a rising and lowering shaft 24 vertically installed on the distal end portion of the main arm 23 so as to ascend and descend, a substantially V-shaped sub-arm 25 journaled on the upper end of the rising and lowering shaft 24 so as to rotate, and a pair of (two) filling nozzles 8 and 9 installed with a predetermined spacing therebetween (equal to the spacing between two adjacent stop positions along the arcuate transportation path) at the two distal ends of a V-shaped sub-arm 25. In addition, a drive means 23*a* that pivots the main arm 23 and a drive means 23*b* that extends and retracts the main arm 23 are installed within the housing-box 26 of the liquid-filling apparatus 1. The drive means 23*b* that extends and retracts the main arm 23 in its length-wise direction is provided at the base end portion of the main arm 23 located inside the housing-box 26. A drive means 24*a* that raises and lowers the rising and lowering shaft 24 relative to the main arm 23 is provided within the distal end portion of the main arm 23, and a drive means 25*a* that rotates the sub-arm 25 is provided within a case 27 that is provided on the sub-arm 25. The drive means are mutually independent servomotors.

In this structure, when the drive means 23*a*, 23*b*, 24*a* and 25*a* are actuated, the main arm 23 is horizontally pivoted and also extended and retracted, and at the same time, the sub-arm 25 and thus the filling nozzles 8 and 9 provided on the sub-arm 25 are rotated in a horizontal plane about the shaft 24 (main arm 23) and, in addition, raised and lowered relative to the main arm 23.

Instead of raising and lowering the rising and lowering shaft 24, the filling nozzles 8 and 9 can be installed on the sub-arm 25 so as to ascend and descend, so that they are raised and lowered by a drive means installed in the sub-arm 25. In addition, instead of installing the sub-arm 25 at the top end of the rising and lowering shaft 24 to rotate, the sub-arm 25 can be rigidly secured to the top end of the rising and lowering shaft 24. Furthermore, the rising and lowering shaft 24 can be installed in the main arm 23 so as to rotate, such that the rising and lowering shaft 24 is rotated by a drive means installed in the main arm 23, thereby enabling the rotation of the sub-arm 25. In any case, the sub-arm 25 is configured to make free rotation in a horizontal plane relative to the main arm 23, and the filling nozzles 8 and 9 are configured to ascend and descend relative to the main arm 23.

The liquid-filling apparatus 1 is provided with the control unit 18. This control unit 18 controls the above-described four drive means 23*a*, 23*b*, 24*a* and 25*a* (servomotors) so as to advance the filling nozzles 8 and 9 along the arcuate transportation path of the two bags 5 in synchronism with the transport of the two bags 5 and, upon reaching the point of advance end, to move the nozzles 8 and 9 back to the initial position and further to lower and raise the nozzles 8 and 9 at predetermined timing of the reciprocating stroke. The "initial position" of the filling nozzle 8 is at the fifth stop position along the arcuate transportation path (marked "V" in FIG. 2) and the point of advance end is at the sixth stop position (marked "VI" in FIG. 2). On the other hand, the "initial position" of the filling nozzle 9 is in the sixth stop position along the arcuate transportation path (marked "VI" in FIG. 2) and the point of advance end is in the seventh stop position (marked "VII" in FIG. 2).

Figure 2:
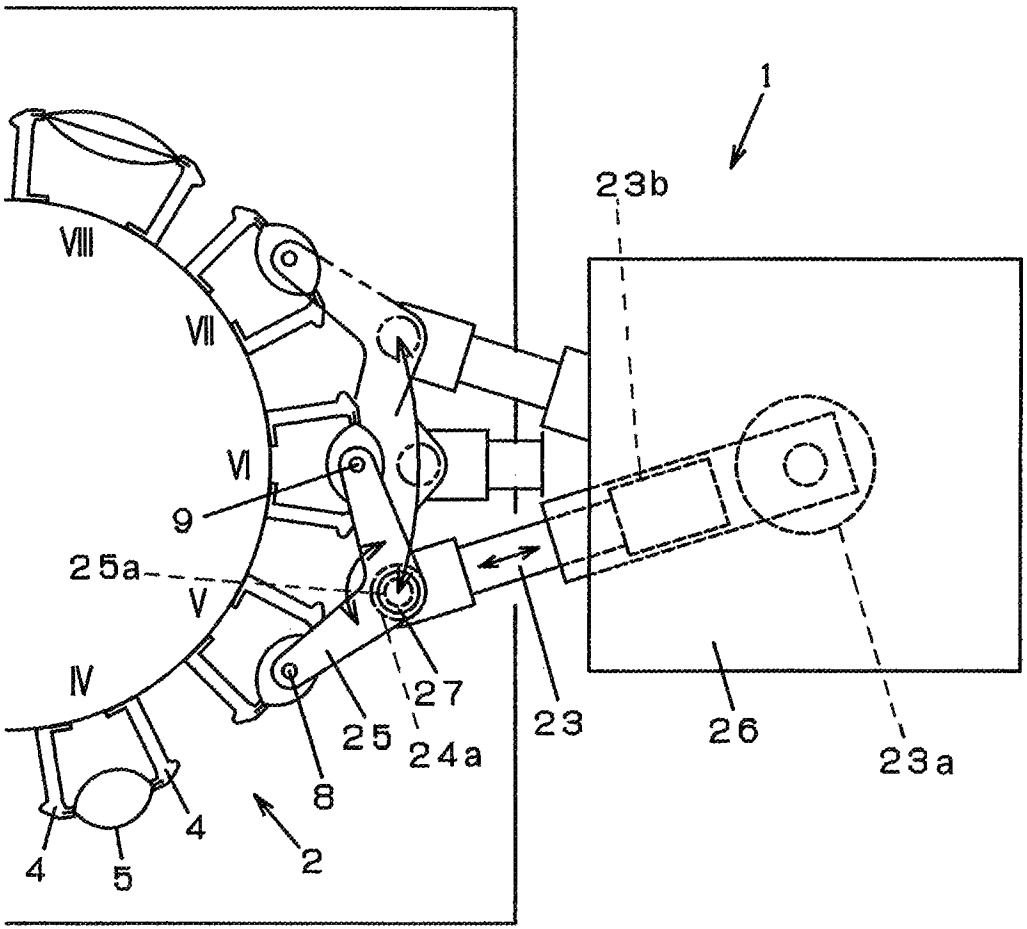
FIG. 2 is a top view of the packaging manipulation apparatus forming part of the packaging machine.
Figure 3:
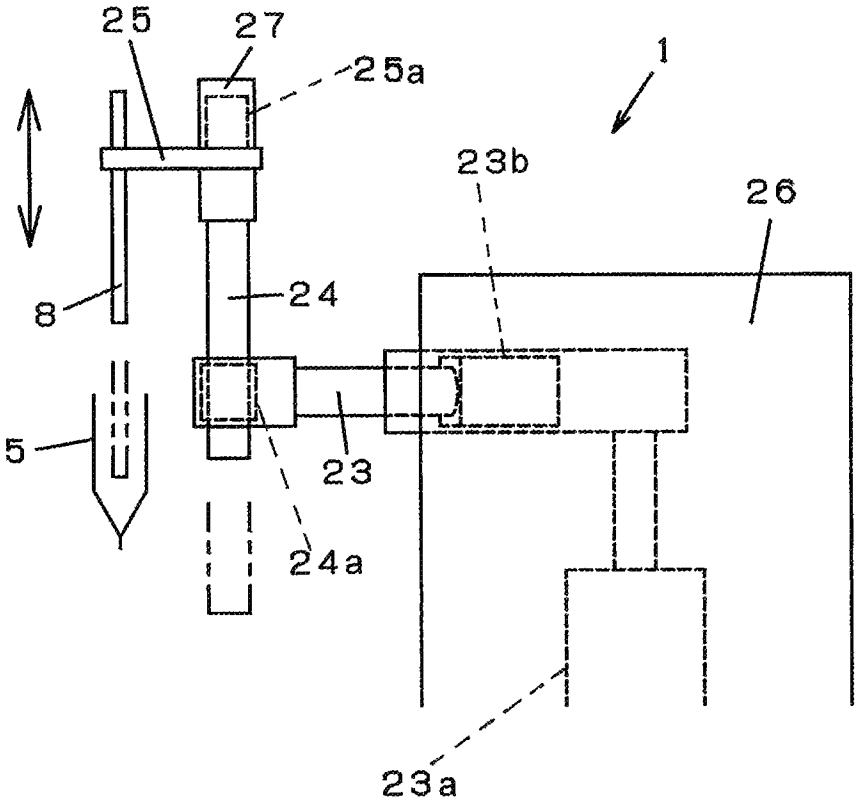
FIG. 3 is a side view of the packaging manipulation apparatus.

Referring now to FIGS. 2 and 3, as a time series, the reciprocating and raising/lowering operations of the filling nozzles 8 and 9 can be described as follows, for example:

(1) At the initial position, the filling nozzles 8 and 9 are in a raised position. The bags 5, with their mouths open, have arrived at and stopped at the 5-th and 6-th stop positions.

(2) The filling nozzles 8 and 9 are then lowered and their discharge orifices are brought into proximity with the bottom of the bags 5 (see the imaginary lines in FIG. 3).

(3) The flow path changeover valves 13 and 14 are switched to establish communication via a flow path between the volume measuring pumps 15 and 16 and the filling nozzles 8 and 9 (the flow path between the volume measuring pumps 15 and 16 and the liquid storage tank 17 is cut off), and the filling nozzles 8 and 9 start filling the bags 5 with liquid.

(4) As the bags 5 are being transported to the next stop position, the filling nozzles 8 and 9, which are moved (advanced) along the arcuate transportation path in synchronism with the transport of the bags 5, reach the point of advance end together with the bags 5. During this forward stroke and while stationary at the point of advance end, the filling nozzles 8 and 9 are raised as the level of the liquid in the bags goes up. During the forward stroke, the main arm 23 is horizontally pivoted while being retracted from a lengthwise-extended state and then extended again to comply with the arcuate bag transportation path. On the other hand, the sub-arm 25 (and the filling nozzles 8 and 9) are rotated (counter-clockwise in FIG. 2) relative to the main arm 23. By being combined, these actions cause the filling nozzles 8 and 9 to advance along the arcuate transportation path. In FIG. 2, the rotation of the sub-arm 25 and the pivoting or extension/retraction of the main arm 23 in the initial position of the filling nozzles 8 and 9 are shown by the solid lines, while the rotation of the sub-arm 25 and the pivoting or extension/retraction of the main arm 23 in intermediate positions during the forward stroke and at the point of advance end of the filling nozzles 8 and 9 are shown by the imaginary lines.

(5) When the filling nozzles 8 and 9 reach the point of advance end, the filling of the bags by the volume measuring pumps 15 and 16 ends, the flow path changeover valves 13 and 14 are switched to cut off the flow path between the volume measuring pumps 15 and 16 and the filling nozzles 8 and 9 (the flow path between the volume measuring pumps 15 and 16 and the liquid storage tank 17 is reestablished), and the filling nozzles 8 and 9 are raised and pulled out of the bags 5. Prior to the start of next filling process, a predetermined amount of liquid is supplied from the liquid storage tank 17 into the volume measuring pumps 15 and 16.

(6) Subsequently, the bags 5 are transported to the site of the next operation and, during this motion, the filling nozzles 8 and 9 are returned (moved back) to the initial positions (V and VI). The path of return can be the same as the path of advance, or it can deviate from it. If the filling nozzles 8 and 9 take deviated path, then any liquid dripping from the filling nozzles 8 and 9 can be prevented from getting on the bags 5. In addition, the main arm 23 can designed not to extend or retract during the return motion of the nozzles.

Figure 4:
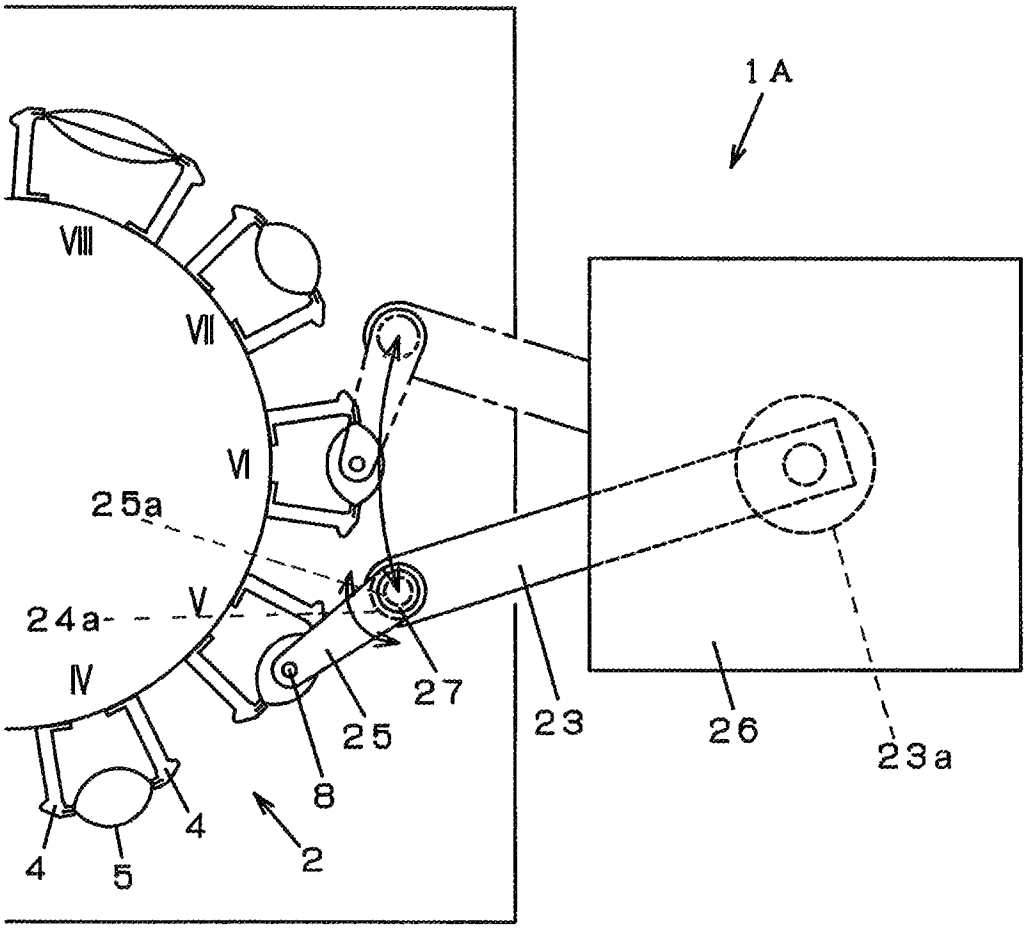
FIG. 4 is a top view of another packaging manipulation apparatus according to the present invention.

FIG. 4 shows another liquid-filling apparatus 1A according to the present invention. The components in FIG. 4 that are substantially equivalent to the components of the liquid-filling apparatus 1 illustrated in FIGS. 1 through 3 are assigned the same reference numerals.

In the same manner as the liquid-filling apparatus 1 shown in FIGS. 1 through 3, the liquid-filling apparatus 1A is disposed at the exterior of the arcuate path of transportation of the bags 5 where liquid filling operations are performed and is provided independent from the rotary-type bag transportation apparatus both structurally and in terms of the drive mechanism. In addition, while not shown in FIG. 4, the liquid-filling apparatus 1A is provided with a flow path changeover valve, a volume measuring pump, a liquid storage tank, etc. as in the structure of FIG. 1.

The liquid-filling apparatus 1A is provided with a main arm 23 that has a pivoting fulcrum at the exterior of the arcuate transportation path along which the bags 5 are transported, and the main arm 23 is installed so as to pivot in a horizontal plane. The liquid-filling apparatus 1A is further provided with a vertical rising and lowering shaft (a member equivalent to the rising and lowering shaft 24 of the liquid-filling apparatus 1) installed at the distal end portion of the main arm 23 so as to ascend and descend, a sub-arm 25 installed on the upper end of the rising and lowering shaft so as to rotate, and a filling nozzle 8 installed at the distal end of the sub-arm 25. In addition, a drive means 23*a* that pivots the main arm 23 is installed inside the housing-box 26 of the liquid-filling apparatus 1A. Also, a drive means 24*a* that raises and lowers the rising and lowering shaft relative to the main arm 23 is provided inside the distal end portion of the main arm 23 and a drive means 25*a* that rotates the sub-arm 25 relative to the rising and lowering shaft is provided inside a case 27 installed in the top portion of the sub-arm 25. These drive means 23*a*, 24*a* and 25*a* are mutually independent servomotors. Accordingly, with the exception that the main arm 23 is configured not to extend and retract and there is only one filling nozzle, the basic construction of the liquid-filling apparatus 1A is substantially the same as the liquid-filling apparatus 1 illustrated in FIGS. 1 through 3.

By the drive means 23*a*, 24*a* and 25*a*, the main arm 23 is horizontally pivoted, and at the same time, the sub-arm 25 and filling nozzle 8 are rotated and raised/lowered relative to the main arm 23.

Instead of raising and lowering the rising and lowering shaft, the filling nozzle 8 is provided on the sub-arm 25 so as to ascend and descend so that the filling nozzle 8 is raised and lowered by a drive means provided in the sub-arm 25. In addition, instead of rotatably installing the sub-arm 25 at the top end of the rising and lowering shaft, it is possible to rigidly provide the sub-arm 25 on the top end of the rising and lowering shaft, and install the rising and lowering shaft rotatably in the main arm 23, so that the rising and lowering shaft is rotated by a drive means installed in the main arm 23. The sub-arm 25 is thus configured to rotate. In any case, the sub-arm 25 is configured to rotate in a horizontal plane relative to the main arm 23, and the filling nozzle 8 is configured to ascend and descend relative to the main arm 23. These aspects of the structure of FIG. 4 are also the same as the liquid-filling apparatus 1 illustrated in FIGS. 1 through 3.

The liquid-filling apparatus 1A includes a control unit as in the liquid-filling apparatus 1 of FIG. 1 that controls the above-described three drive means 23*a*, 24*a* and 25*a* (servomotors) so as to advance the filling nozzle 8 along the arcuate path of transportation of the bags 5 in synchronism with the transport of the bags 5 and, upon reaching the point of advance end, move the nozzle back to the initial position and further to lower and raise it at predetermined timing during the reciprocating stroke (or during the pivot motion of the arm 23). If the rotary-type bag transportation apparatus in FIG. 4 is the same as the one illustrated in FIGS. 1 and 2, the "initial position" of the filling nozzle 8 is in the fifth stop position along the arcuate transportation path (marked "V" in FIG. 4) and the point of advance end is in the sixth stop position (marked "VI" in FIG. 4).

In this liquid-filling apparatus 1A of FIG. 4, the reciprocating operation and the raising/lowering operations of the filling nozzle 8 can be considered substantially identical to the liquid-filling apparatus 1 of FIGS. 1 through 3. In FIG. 4, the state of the sub-arm 25 and main arm 23 in the initial position of the filling nozzle 8 is shown by the solid lines, while the state of the sub-arm 25 and main arm 23 at the point of advance end of the filling nozzle 8 is shown by the imaginary lines.

The liquid-filling apparatus 1A has only one filling nozzle 8. Accordingly, the nozzle 8 needs to return (moved back) to the initial position of the forward stroke while the bag 5 is stationary in the sixth stop position (the point of advance end of the filling nozzle 8), and this makes the filling time and return time shorter in comparison with the liquid-filling apparatus 1 of FIGS. 1 through 3. Instead, the seventh stop position (marked "VII" in FIG. 4), which is used for a filling operation in the liquid-filling apparatus 1 of FIGS. 1 through 3, can be used for another packaging manipulation operation, e.g. for blowing steam into the bag, etc.

Figure 5:
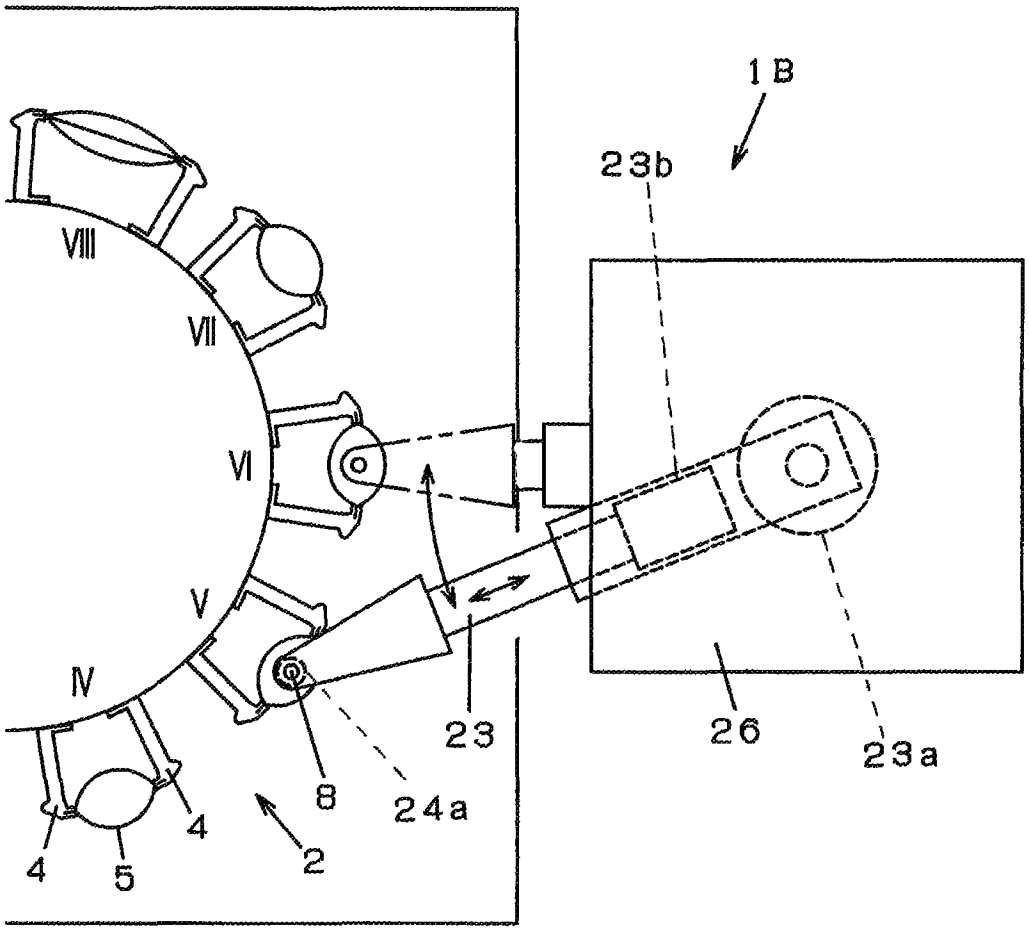
FIG. 5 is a top view of yet another packaging manipulation apparatus according to the present invention.

Next, yet another liquid-filling apparatus 1B of the present invention will be described with reference to FIG. 5. In FIG. 5, the components that are substantially equivalent to the components of the liquid-filling apparatus 1 illustrated in FIGS. 2 and 3 are assigned the same numerals.

In the same manner as the liquid-filling apparatus 1 illustrated in FIGS. 2 and 3, the liquid-filling apparatus 1B is disposed at the exterior of the arcuate path of transportation of the bags 5 where liquid filling operations are performed and is independent from the rotary-type bag transportation apparatus both structurally and in terms of its drive mechanism. In addition, though not shown in FIG. 5, the liquid-filling apparatus 1B is provided with a flow path changeover valve, a volume measuring pump, a liquid storage tank, etc.

The liquid-filling apparatus 1B is provided with an arm 23 that has a pivoting fulcrum at the exterior of the arcuate path of transportation of the bags 5 and is configured to pivot in a horizontal plane and also to extend and retract in its length-wise direction. A filling nozzle 8 is installed in the distal end portion of the arm 23 so as to ascend and descend. In addition, a drive means 23*a* that pivots the arm 23 and a drive means 23*b* that extends and retracts the arm 23 are provided inside the housing-box 26 of the liquid-filling apparatus 1B. The drive means 23*b* that extends and retracts the arm 23 in its length-wise direction is provided at the base end portion of the arm 23 located inside the housing-box 26. A drive means 24*a* that raises and lowers the filling nozzle 8 is provided inside the distal end portion of the arm 23. The drive means are mutually independent servomotors.

By actuating the drive means 23*a*, 23*b* and 24*a*, the arm 23 is horizontally pivoted and also extended and retracted, and the filling nozzle 8 is raised and lowered relative to the arm 23.

The liquid-filling apparatus 1B is provided with a control unit as in the liquid-filling apparatus 1 of FIG. 1 that controls the above-described three drive means 23*a*, 23*b* and 24*a* (servomotors) so as to advance the filling nozzle 8 along the arcuate path of transportation of the bags 5 in synchronism with the transport of the bags 5 and, upon reaching the point of advance end, move the nozzle back to the initial position and further to lower and raise the nozzle 8 at predetermined timing of the reciprocating stroke. If the rotary-type bag transportation apparatus is the same as the one illustrated in FIG. 2, the "initial position" of the filling nozzle 8 is in the fifth stop position along the arcuate transportation path (marked "V" in FIG. 5) and the point of advance end is in the sixth stop position (marked "VI" in FIG. 5).

In the liquid-filling apparatus 1B, the reciprocating and raising/lowering operations of the filling nozzle 8 are substantially identical to the liquid-filling apparatus 1A illustrated in FIG. 4. In FIG. 5, the arm 23 in the initial position of the filling nozzle 8 is shown by the solid lines, while the arm 23 at the point of advance end of the filling nozzle 8 is shown by the imaginary lines.

The liquid-filling apparatus 1B has only one filling nozzle 8, and the nozzle 8 returns (moved back) to the initial position of the forward stroke while the bag 5 is stationary in the sixth stop position (the point of advance end of the filling nozzle 8). Thus, the filling time and return time shorter is in comparison with the liquid-filling apparatus 1 illustrated in FIG. 2. Instead, the seventh stop position (marked "VII" in FIG. 5), which is used for a filling operation in the liquid-filling apparatus 1 illustrated in FIG. 2, can be used for another packaging manipulation operation, e.g. for blowing in steam, etc.

Still another liquid-filling apparatus 1C according to the present invention will be described with reference to FIG. 6. Components that are substantially the same as those of the liquid-filling apparatus 1 illustrated in FIGS. 1 through 3 are assigned the same numerals in FIG. 6.

In the same manner as the liquid-filling apparatus 1 illustrated in FIGS. 1 through 3, the liquid-filling apparatus 1C is disposed at the exterior of the arcuate transportation path where liquid filling operations are performed and is provided independently from a rotary-type bag transportation apparatus (not shown) both structurally and in terms of its drive mechanism.

The liquid-filling apparatus 1C is configured to be used with a so-called W-type bag filling packaging machine (e.g. see Japanese Patent Application Laid-Open (Kokai) No. 2004-244085), which performs packaging operations on two bags simultaneously during all the operations. The rotary-type bag transportation apparatus used in this case is a W-type apparatus that intermittently transports two bags simultaneously along the circular transportation path (consisting of arcuate transportation path).

The liquid-filling apparatus 1C has a pair of nozzles 8 and 28 and a pair of nozzles 9 and 29, thus a total of four filling nozzles 8, 28, 9 and 29 are provided so that the liquid-filling apparatus 1C is used with a W-type rotary bag transportation apparatus. It further includes supply conduits 11 and 31, flow path changeover valves 13 and 33, and volume measuring pumps 15 and 35 for the nozzle 8 and 9; and for the nozzles 9 and 29, supply conduits 12 and 32, flow path changeover valves 14 and 34, and volume measuring pumps 16 and 36 are provided.

All of the other basic structures of the liquid-filling apparatus 1C are the same as those of the liquid-filling apparatus 1 illustrated in FIGS. 1 through 3, i.e. it is provided with a main arm 23, a rising and lowering shaft 24, and sub-arm 25 with the filling nozzles 8 and 28 and the filing nozzles 9 and 29 installed on each of the sub-arm 25. In addition, the functionality of the main arm 23, the rising and lowering shaft 24, and the sub-arm 25 is the same as that of the liquid-filling apparatus 1 shown in FIGS. 1 through 3, including the drive means (23*a*, 23*b*, 24*a* and 25*a*, servomotors).

In this structure, if, as in the same manner as in the apparatus of FIG. 1, a full rotation of the W-type rotary bag transportation apparatus makes ten (10) stops and the bags are filled with liquid by the liquid-filling apparatus 1C between the fifth stop position and seventh stop position, then the initial position of the filling nozzles 8 and 28 is in the fifth stop position along the arcuate transportation path and their point of advance end is in the sixth stop position; on the other hand, the initial position of the filling nozzles 9 and 29 is in the sixth stop position along the arcuate transportation path and their point of advance end is in the seventh stop position. The filling nozzles 8 and 28 and the filling nozzles 9 and 29 are advanced from their respective initial positions to the points of advance end along the arcuate transportation path in synchronism with the transport of the bags; and upon reaching the points of advance end, they are moved back to the initial positions; and during this advance and return motion, the fillings nozzles 8, 28, 9 and 29 are lowered and raised at predetermined timing during the reciprocating stroke (or the pivot motion of the arm 23).

Figure 6:
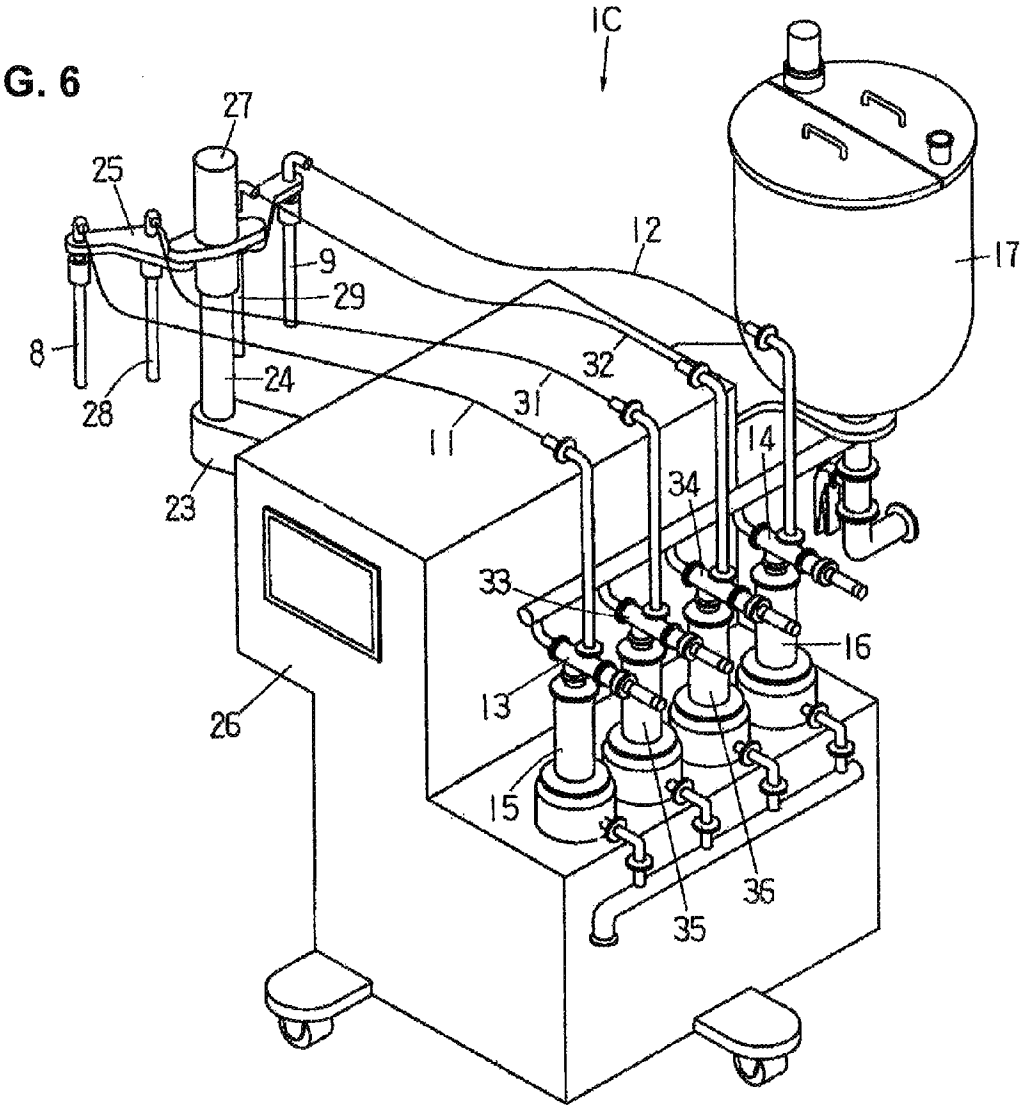
FIG. 6 is a perspective view of still another packaging manipulation apparatus according to the present invention.

In the above-described structure of FIG. 6, one sub-arm 25 is provided; however, the sub-arm 25 can be formed by a plurality of arm elements each having a filling nozzle(s).

The invention claimed is:

1. A standalone packaging manipulation apparatus disposed adjacent to a rotary container transportation apparatus having an arcuate transportation path and performs predetermined packaging manipulation operations simultaneously on a plurality of containers being transported along the arcuate transportation path, said standalone packaging manipulation apparatus comprising:

an main arm having a pivoting fulcrum at an exterior of said arcuate transportation path and configured to pivot horizontally and to extend and retract;

a sub-arm provided at a distal end portion of said main arm and configured to rotate horizontally;

a plurality of packaging manipulating members configured to ascend and descend relative to said main arm, said packaging manipulating members being installed on said sub-arm with a predetermined spacing therebetween and for performing packaging manipulation operations simultaneously on said plurality of containers;

a drive means for pivoting said main arm horizontally;

a drive means for extending and retracting said main arm;

a drive means for rotating said sub-arm about an axis thereof;

a drive means for raising and lowering said packaging manipulating members; and a control unit for controlling said drive means to advance said plurality of packaging manipulating members along said arcuate transportation path in synchronism with transport of said plurality of containers and, upon reaching a point of advance end, move said plurality of packaging manipulating members back to initial positions thereof, and to raise and lower said plurality of packaging manipulating members at predetermined timing during reciprocating stroke of said packaging manipulating members.

2. The standalone packaging manipulation apparatus according claim 1, wherein said drive means are mutually independent servomotors.

3. The standalone packaging manipulation apparatus according to claim 1, wherein a path of return of said packaging manipulating member is different from a path of advance thereof.

4. The standalone packaging manipulation apparatus according to claim 3, wherein the path of return of said packaging manipulating member is rectilinear.

5. The standalone packaging manipulation apparatus according to claim 1, wherein said packaging manipulating member is a liquid-filling nozzle.

6. The standalone packaging manipulation apparatus according to claim 1, wherein said rotary-type container transportation apparatus is an intermittent rotary-type container transportation apparatus for intermittently transporting said containers along said transportation path; and said packaging manipulating member is moved forward with an intermittent motion during a forward stroke and moved back to initial positions in a continuous motion.

* * * * *